US011391013B2

(12) United States Patent
Vahling

(10) Patent No.: US 11,391,013 B2
(45) Date of Patent: Jul. 19, 2022

(54) ADJUSTMENT SYSTEM FOR BLADE ASSEMBLY

(71) Applicant: Caterpillar Inc., Deerfield, IL (US)

(72) Inventor: Bruce Raymond Vahling, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 502 days.

(21) Appl. No.: 16/458,270

(22) Filed: Jul. 1, 2019

(65) Prior Publication Data

US 2021/0002855 A1 Jan. 7, 2021

(51) Int. Cl.
*E02F 3/84* (2006.01)
*E02F 3/815* (2006.01)

(52) U.S. Cl.
CPC ..... *E02F 3/844* (2013.01); *E02F 3/8157* (2013.01)

(58) Field of Classification Search
CPC ..... E02F 3/7654; E02F 3/8157; E02F 3/844
See application file for complete search history.

(56) References Cited

U.S. PATENT DOCUMENTS 3,463,243 A 8/1969 Fisher
3,465,829 A 9/1969 Fisher et al.
3,891,065 A * 6/1975 Iijima ..... E02F 3/386 188/41
3,983,945 A 10/1976 Hart et al.
4,058,174 A * 11/1977 Atherton ..... E02F 3/3618 172/781
4,105,078 A 8/1978 Gilbert
4,683,959 A * 8/1987 Clemens ..... E02F 3/8157 172/667
5,076,370 A 12/1991 Stubben et al.
5,687,800 A 11/1997 Wilkening
5,926,982 A * 7/1999 Keech ..... E02F 9/2866 37/455
6,585,059 B2 7/2003 Michael, Jr. et al.
6,799,640 B2 10/2004 McGugan
6,904,978 B2 6/2005 McGugan
7,650,949 B1 1/2010 Horstman
7,658,236 B2 * 2/2010 Howson ..... E02F 3/3604 172/780
8,316,956 B2 11/2012 Horstman et al.
9,809,950 B2 11/2017 Zimmerman et al.
2006/0070758 A1 4/2006 Ryan et al.
2006/0130305 A1 6/2006 Englot
2017/0130422 A1 5/2017 Zimmerman et al.
2018/0106013 A1 4/2018 Cox et al.

* cited by examiner

*Primary Examiner* — Gary S Hartmann

(57) ABSTRACT

An adjustment system includes an adjustment mechanism disposed in association with a wear element of a blade of a motor grader, and a controller. The controller is configured to receive a signal indicative of actuating the adjustment mechanism. The controller is configured to actuate the adjustment mechanism to force the wear element against a surface of the blade. The controller is configured to release the adjustment mechanism to unforce the wear element against the surface of the blade. The controller is configured to actuate at least one side shift cylinder to move the blade in a first direction. The controller is also configured to actuate the at least one side shift cylinder to move the blade in a second direction. The controller is further configured to lock the adjustment mechanism to retain the wear element against the surface of the blade.

20 Claims, 7 Drawing Sheets

ADJUSTMENT SYSTEM FOR BLADE ASSEMBLY

TECHNICAL FIELD

The present disclosure relates to a blade assembly. More particularly, the present disclosure relates to an adjustment system for the blade assembly of a motor grader.

BACKGROUND

Grader machines, often referred to as motor graders, are typically used to displace, distribute, mix, and grade a material, such as soil, over a work surface. Grader machines commonly employ a blade or moldboard to carry out one or more of these functions. Some machines may provide for lateral movement of the blade, thereby allowing the blade to assume various work-related positions relative to the work surface.

Commonly, a wear strip is employed between a mounting member and the blade for the blade to slide against. As the wear strip may wear out, adjustment and/or alignment may be required of the wear strip relative to the mounting member and/or the blade. However, adjustment and/or alignment of the wear strip may be a laborious and time intensive process due to complex mounting arrangements around the wear strip. Additionally, multidirectional adjustment may be required between the mounting member and the blade, in turn, increasing labor effort and skill. Hence, there is a need for an improved adjustment system for such applications.

U.S. Pat. No. 6,799,640 describes a bearing support arrangement for a grader blade. The bearing support arrangement includes short stroke hydraulic cylinders to compensate for wear between slide bearings and slide rails of the grader blade. The cylinders are pressurized by grease and a grease fitting is provided for each cylinder to provide with an access to allow service by an operator. The cylinders are located in a closed cavity between the bearing support holder and the slide bearing.

SUMMARY OF THE DISCLOSURE

In an aspect of the present disclosure, an adjustment system for a blade of a motor grader is provided. The adjustment system includes an adjustment mechanism disposed in association with a wear element of the blade. The adjustment system also includes a controller communicably coupled to the adjustment mechanism. The controller is configured to receive a signal indicative of actuating the adjustment mechanism. The controller is configured to actuate the adjustment mechanism to force the wear element against a surface of the blade. The controller is configured to release the adjustment mechanism to unforce the wear element against the surface of the blade. The controller is configured to actuate at least one side shift cylinder to move the blade in a first direction. The controller is also configured to actuate the at least one side shift cylinder to move the blade in a second direction. The second direction is opposite to the first direction. The controller is further configured to lock the adjustment mechanism to retain the wear element against the surface of the blade.

In another aspect of the present disclosure, a blade assembly for a motor grader is provided. The blade assembly includes a blade adapted to engage a work surface. The blade assembly includes a mounting bracket disposed on a frame of the motor grader. The blade assembly also includes a wear element disposed within the mounting bracket. The wear element is adapted to movably receive a surface of the blade thereon. The blade assembly further includes an adjustment system. The adjustment system includes an adjustment mechanism disposed in association with the mounting bracket and the wear element. The adjustment system also includes a controller communicably coupled to the adjustment mechanism. The controller is configured to receive a signal indicative of actuating the adjustment mechanism. The controller is configured to actuate the adjustment mechanism to force the wear element against the surface of the blade. The controller is configured to release the adjustment mechanism to unforce the wear element against the surface of the blade. The controller is configured to actuate at least one side shift cylinder to move the blade in a first direction. The controller is also configured to actuate the at least one side shift cylinder to move the blade in a second direction. The second direction is opposite to the first direction. The controller is further configured to lock the adjustment mechanism to retain the wear element against the surface of the blade.

In yet another aspect of the present disclosure, a method of adjusting a blade of a motor grader is provided. The method includes receiving a signal indicative of actuating an adjustment mechanism associated with the blade. The method includes actuating the adjustment mechanism to force a wear element against a surface of the blade. The method includes releasing the adjustment mechanism to unforce the wear element against the surface of the blade. The method includes actuating at least one side shift cylinder to move the blade in a first direction. The method also includes actuating the at least one side shift cylinder to move the blade in a second direction. The method further includes locking the adjustment mechanism to retain the wear element against the surface of the blade.

Other features and aspects of this disclosure will be apparent from the following description and the accompanying drawings.

DETAILED DESCRIPTION

Figure 1:
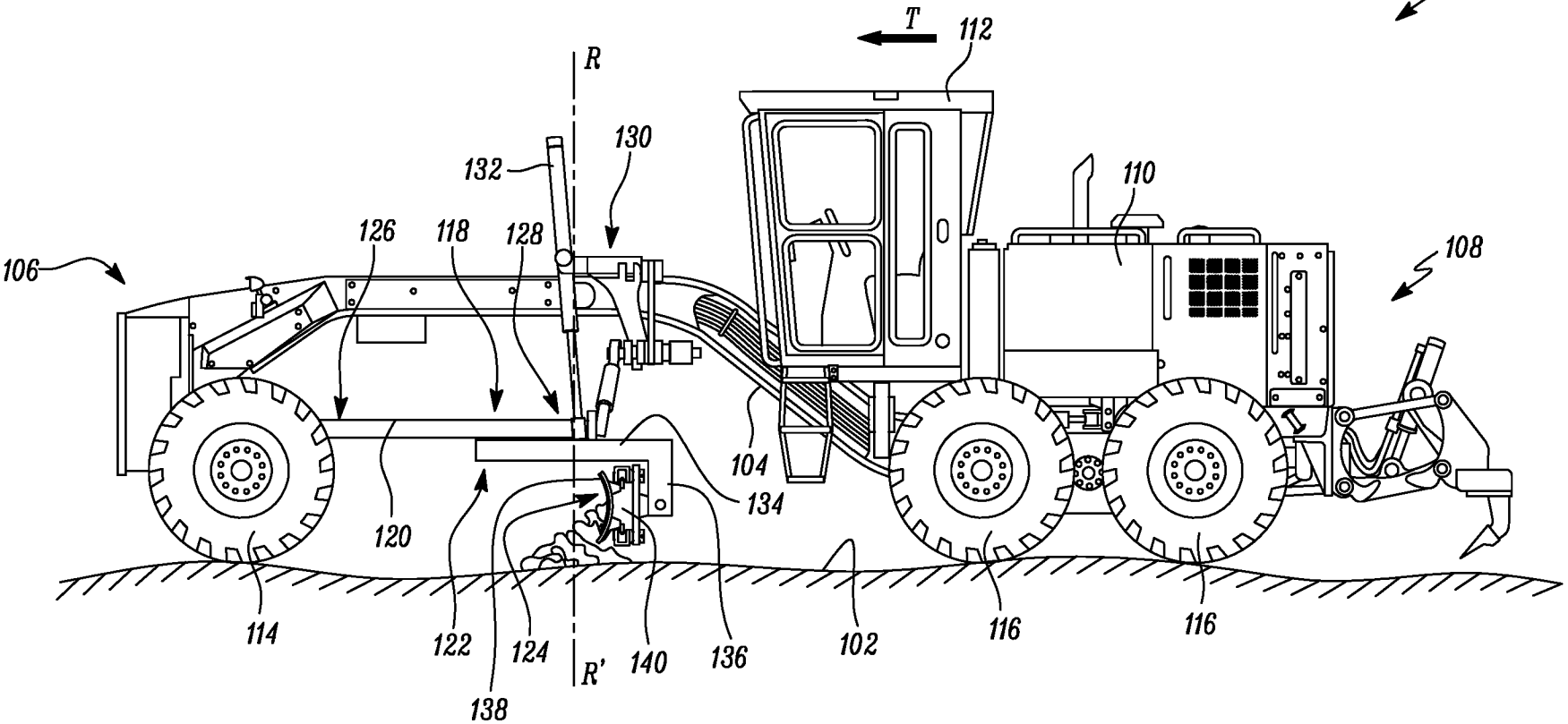
FIG. 1 is a side view of an exemplary motor grader, according to one embodiment of the present disclosure.

Wherever possible, the same reference numbers will be used throughout the drawings to refer to the same or the like parts. Referring to FIG. 1, a side view of an exemplary motor grader 100 is illustrated. The motor grader 100 may be used to displace, spread, distribute, level, and/or grade materials, such as soil, over a work surface 102 during a grading operation. The motor grader 100 includes a frame 104. The frame 104 defines a front end 106 and a rear end 108 with respect to a direction of travel "T" of the motor grader 100. The frame 104 supports one or more components of the motor grader 100. The motor grader 100 includes an enclosure 110 mounted on the frame 104. The enclosure 110 houses a power source (not shown), such as an engine, batteries, and the like, of the motor grader 100. The power source provides power to the motor grader 100 for operational and mobility requirements.

The motor grader 100 includes an operator cabin 112 mounted on the frame 104. The operator cabin 112 includes various controls (not shown), such as a steering, a joystick, an operator console, an operator seat, levers, pedals, buttons, switches, knobs, and the like. The controls are adapted to control the motor grader 100 on the work surface 102. The motor grader 100 includes a set of front wheels 114 and a set of rear wheels 116 rotatably mounted to the frame 104. Each of the front wheels 114 and the rear wheels 116 support and provide mobility to the motor grader 100 on the work surface 102.

The motor grader 100 includes a grader group 118 movably mounted to the frame 104. The grader group 118 is adapted to level and grade material over the work surface 102 during the grading operation. The grader group 118 includes a drawbar 120, a circle assembly 122, and a blade assembly 124. The drawbar 120 includes a first end 126 pivotally coupled to the front end 106 of the frame 104. The drawbar 120 includes a second end 128 movably coupled to a mid-portion 130 of the frame 104 via one or more actuators 132, such as a hydraulic actuator. The actuator 132 may be actuated to raise or lower the second end 128 of the drawbar 120 with respect to the frame 104, in turn, allowing the grader group 118 to be raised or lowered with respect to the work surface 102.

The circle assembly 122 includes a circle member 134 and an arm 136. The circle member 134 rotates with respect to the drawbar 120 about a rotation axis R-R' of the circle member 134. The arm 136 extends from the circle member 134 and rotates with a rotation of the circle member 134 with respect to the drawbar 120. The arm 136 extends from the circle member 134 in an axial direction along the rotation axis R-R. In the illustrated embodiment, the circle assembly 122 includes a single arm 136. In other embodiments, the circle assembly 122 may include multiple arms, such that each of the multiple arms may be disposed spaced apart with respect to one another on the circle member 134.

Figure 2:
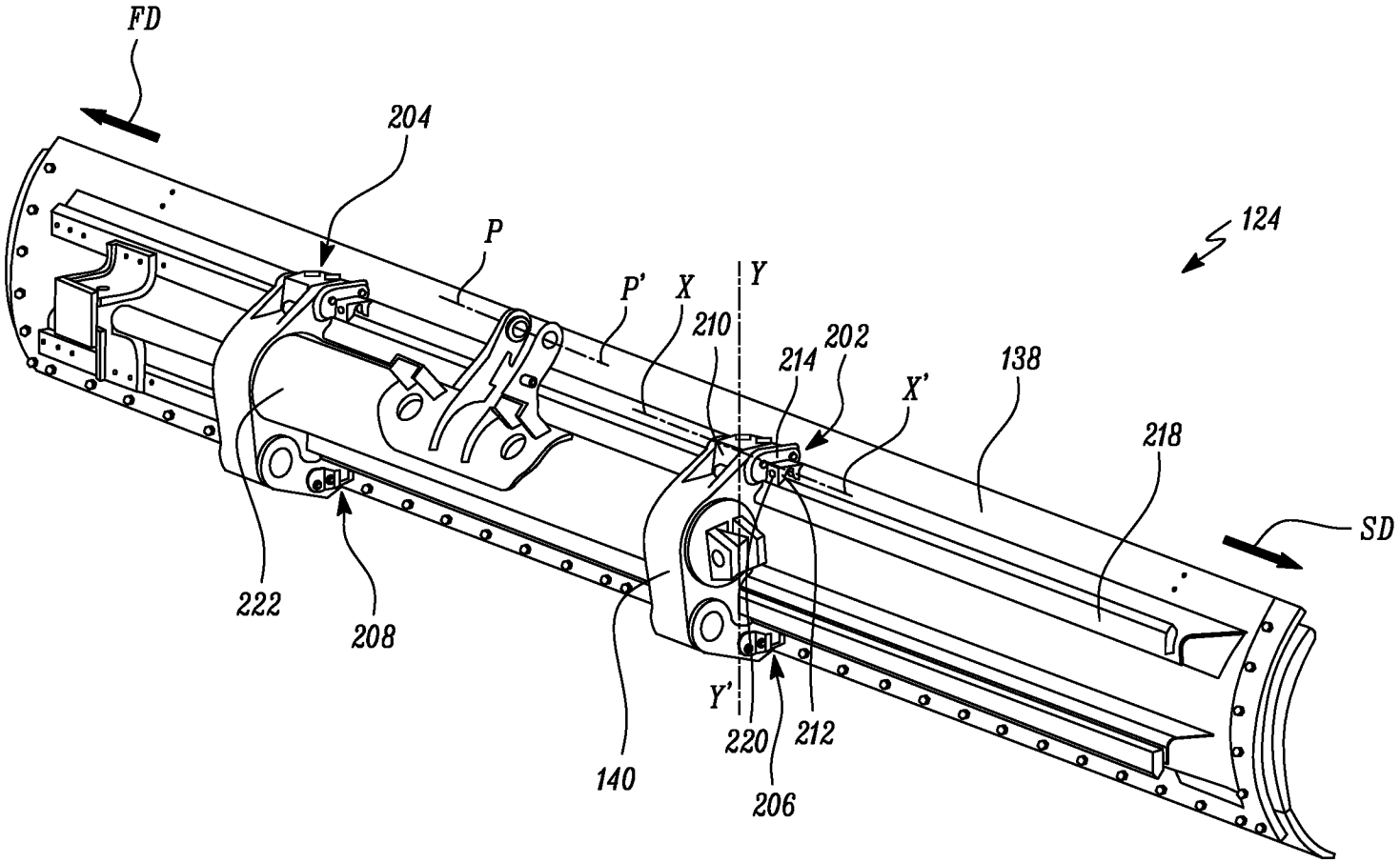
FIG. 2 is a perspective view of a blade assembly of the motor grader of FIG. 1, according to one embodiment of the present disclosure.

Referring to FIGS. 1 and 2, the blade assembly 124 includes a blade 138, a support member 140, and a number of mounting assemblies, such as first mounting assemblies 202, 204 and second mounting assemblies 206, 208. In the accompanying figure, two first mounting assemblies 202, 204 and two second mounting assemblies 206, 208 are shown. It should be noted that, in other embodiments, the blade assembly 124 may include single or multiple first mounting assemblies and/or single or multiple second mounting assemblies, based on application requirements. The blade assembly 124 is mounted to the arm 136 via the support member 140. The support member 140 is movably coupled to the arm 136, such that the support member 140 pivots about a pivot axis P-P' with respect to the frame 104.

The blade 138 is mounted to the support member 140 via each of the first mounting assemblies 202, 204 and each of the second mounting assemblies 206, 208. As such, the blade 138 pivots about the pivot axis P-P' with respect to the frame 104. Also, the blade 138 slides substantially parallel to the pivot axis P-P' with respect to each of the first mounting assemblies 202, 204 and each of the second mounting assemblies 206, 208. The blade 138 engages the work surface 102 during the grading operation. For purpose of clarity and explanation, the mounting assembly will now be explained with reference to the first mounting assembly 202. It should be noted that each of the first mounting assembly 204 and the second mounting assemblies 206, 208 has a configuration similar to a configuration of the first mounting assembly 202.

The first mounting assembly 202 includes a mounting bracket 210. The mounting bracket 210 is mounted to the support member 140. The mounting bracket 210 defines a longitudinal axis X-X' and a lateral axis Y-Y. The longitudinal axis X-X' is substantially parallel to the pivot axis P-P. The lateral axis Y-Y' is substantially perpendicular to the longitudinal axis X-X' and the pivot axis P-P. The first mounting assembly 202 also includes an adjustment block 212. The adjustment block 212 is disposed in the mounting bracket 210. The first mounting assembly 202 also includes two retention plates 214 (only one retention plate 214 shown in the accompanying figure) disposed on opposite ends of the mounting bracket 210 relative to the longitudinal axis X-X.

Each of the retention plates 214 is disposed on the mounting bracket 210 in association with the adjustment block 212. More specifically, each of the retention plates 214 engages with the adjustment block 212 via one or more engaging surfaces (not shown), such as one or more slots, grooves, and so on, provided on the adjustment block 212. As such, each of the retention plates 214 is adapted to limit longitudinal movement of the adjustment block 212 along the longitudinal axis X-X' relative to the mounting bracket 210. Also, each of the retention plates 214 is adapted to allow lateral movement of the adjustment block 212 along the lateral axis Y-Y' relative to the mounting bracket 210.

Figure 3A:
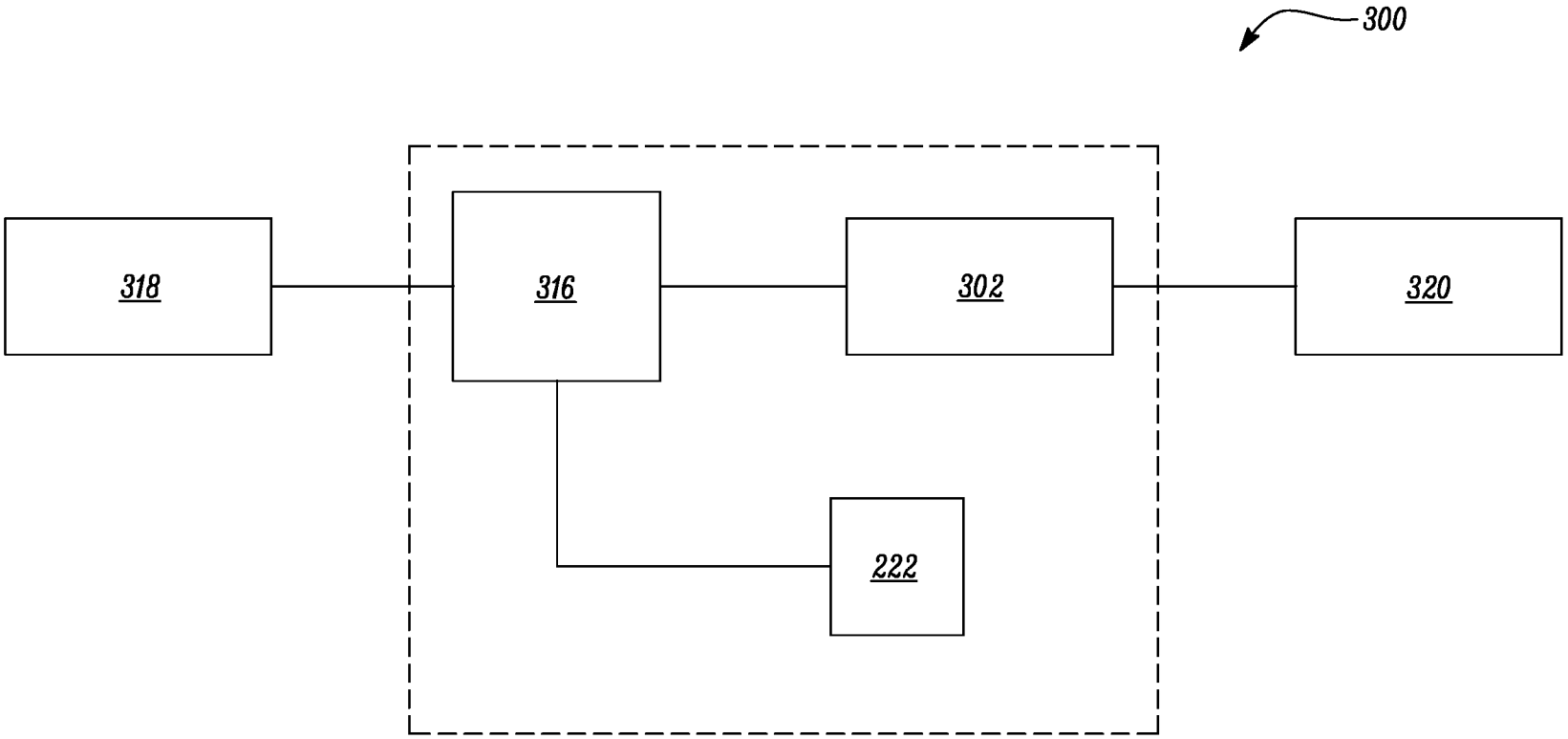
FIG. 3A is a schematic representation of an adjustment system for the blade assembly of FIG. 2, according to one embodiment of the present disclosure.
Figure 3B:
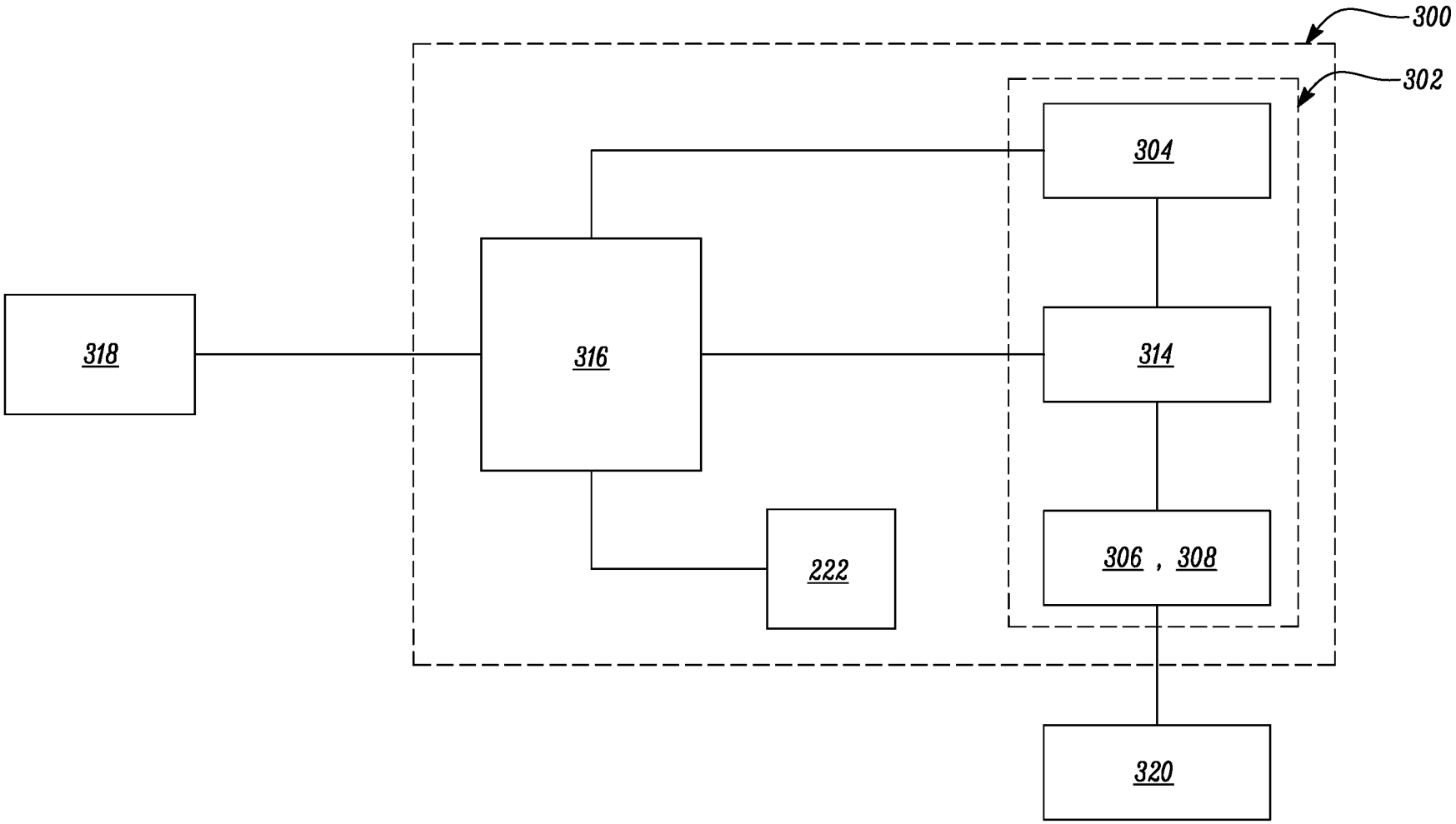
FIG. 3B is a schematic representation of an adjustment mechanism of the adjustment system of FIG. 3A, according to one embodiment of the present disclosure.
Figure 3C:
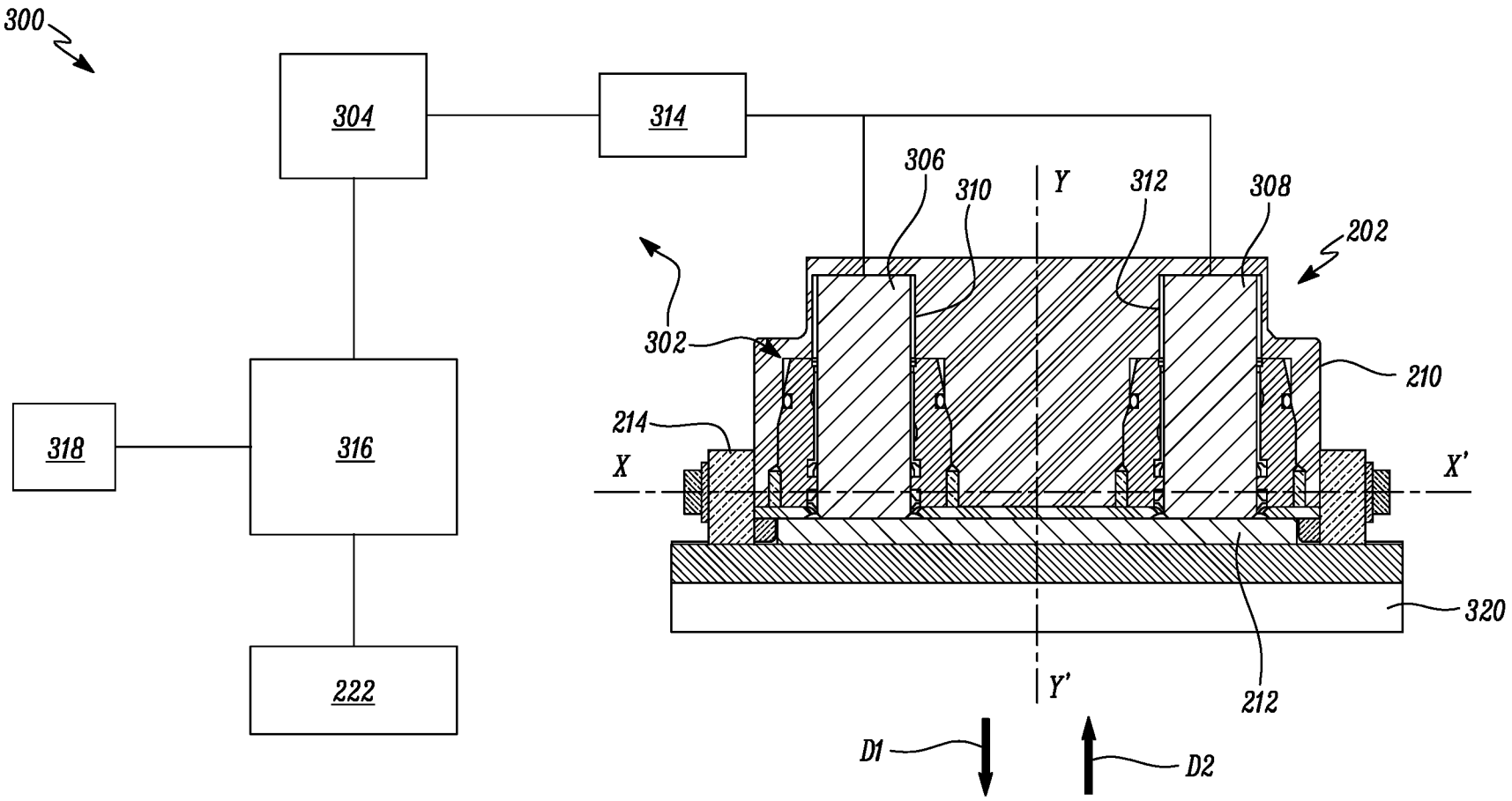
FIG. 3C is another schematic representation of the adjustment mechanism of FIG. 3B showing a cross-sectional view of a mounting bracket of the blade assembly of FIG. 2 in a forced position, according to one or more embodiments of the present disclosure.

The first mounting assembly 202 further includes a wear element 320 (shown in FIG. 3C). The wear element 320 is disposed in the adjustment block 212. The wear element 320 is adapted to slidably receive a surface of the blade 138, such as a mounting rail 218 of the blade 138. More specifically, the wear element 320 is adapted to provide a sacrificial wear surface between the mounting rail 218 of the blade 138 and the adjustment block 212. In an assembled position of the mounting rail 218 on the wear element 320, the mounting rail 218 limits lateral movement of the wear element 320 and the adjustment block 212 out of the mounting bracket 210 along the lateral axis Y-Y.

The first mounting assembly 202 also includes two retention screws 220 (only one retention screw 220 shown in the accompanying figure) disposed on opposite ends of the adjustment block 212 relative to the longitudinal axis X-X. Each of the retention screws 220 is disposed on the adjustment block 212 in association with the wear element 320. More specifically, each of the retention screws 220 engages with opposite ends of the wear element 320 relative to the longitudinal axis X-X. As such, each of the retention screws 220 is adapted to limit longitudinal movement of the wear element 320 along the longitudinal axis X-X' relative to the adjustment block 212. Also, each of the retention screws 220 is adapted to allow lateral movement of the wear element 320 along the lateral axis Y-Y' relative to the adjustment block 212 and/or the mounting bracket 210.

The blade assembly 124 also includes at least one side shift cylinder 222. In the illustrated embodiment, the blade assembly 124 includes a single side shift cylinder 222. In other embodiments, the blade assembly 124 may include multiple side shift cylinders, based on application requirements. The side shift cylinder 222 is disposed on the support member 140 and is operably coupled to the mounting rail 218 of the blade 138. Based on an extension and a retraction of the side shift cylinder 222, the side shift cylinder 222 is adapted to slide the blade 138 substantially parallel to the pivot axis P-P' along the mounting rail 218 with respect to each of the first mounting assemblies 202, 204 and each of the second mounting assemblies 206, 208.

Referring to FIG. 3A, the blade assembly 124 also includes an adjustment system 300. The adjustment system 300 will be hereinafter interchangeably referred to as the "system 300". The system 300 includes an adjustment mechanism 302. The adjustment mechanism 302 will be hereinafter interchangeably referred to as the "mechanism 302". The mechanism 302 is adapted to adjust the wear element 320 relative to the surface of the blade 138, such as the mounting rail 218. As such, the mechanism 302 is disposed in association with the mounting bracket 210 and the wear element 320. Referring to FIG. 3B, a schematic representation of the mechanism 302 of the system 300 is illustrated. Referring to FIG. 3C, another schematic representation of the mechanism 302 showing a cross-sectional view of the first mounting assembly 202 is illustrated. The system 300 and the mechanism 302 will be now be explained with combined reference to FIGS. 3A, 3B, and 3C.

In the illustrated embodiment, the mechanism 302 is a hydraulic adjustment mechanism. Accordingly, the mechanism 302 includes a hydraulic pump 304. The hydraulic pump 304 is adapted to provide a flow of hydraulic fluid, such as hydraulic oil, within the mechanism 302. The hydraulic pump 304 may be any fluid delivery pump, such as a piston pump, a gear pump, a gerotor pump, a screw pump, a centrifugal pump, and so on, based on application requirements. The mechanism 302 also includes one or more pistons 306, 308 disposed movably within the mounting bracket 210. More specifically, the mounting bracket 210 includes one or more bores 310, 312 adapted to movably receive the one or more pistons 306, 308 respectively.

In the illustrated embodiment, the mechanism 302 includes two pistons 306, 308. Accordingly, the mounting bracket 210 includes two bores 310, 312 disposed adjacent to each other, such that each of the bores 310, 312 movably receives each of the pistons 306, 308, respectively. In other embodiments, the mechanism 302 may include single or multiple pistons. Accordingly, the mounting bracket 210 may include single or multiple bores in order to movably receive the single or multiple pistons, respectively. Each of the bores 310, 312 and the pistons 306, 308 are operably coupled to the hydraulic pump 304. Accordingly, based on the flow of hydraulic fluid from the hydraulic pump 304 into each of the bores 310, 312, each of the pistons 306, 308 is adapted to move in a direction "D1" along the lateral axis Y-Y' of the mounting bracket 210. Additionally, each of the pistons 306, 308 is operably coupled to the adjustment block 212 and the wear element 320. Accordingly, based on movement of each of the pistons 306, 308 in the direction "D1" along the lateral axis Y-Y', the adjustment block 212 and the wear element 320 is adapted to slidably move in the direction "D1" along the lateral axis Y-Y' within the mounting bracket 210.

The mechanism 302 also includes a hydraulic valve 314. The hydraulic valve 314 is operably coupled to the hydraulic pump 304 and each of the bores 310, 312 and the pistons 306, 308. Accordingly, based on an operating position of the hydraulic valve 314, the hydraulic valve 314 is adapted to control the flow of hydraulic fluid from the hydraulic pump 304 to each of the bores 310, 312 and the pistons 306, 308, and vice versa. For example, in a closed position of the hydraulic valve 314, the hydraulic valve 314 is adapted to limit the flow of hydraulic fluid from the hydraulic pump 304 to each of the bores 310, 312 and the pistons 306, 308, and vice versa. Also, in an open position of the hydraulic valve 314, the hydraulic valve 314 is adapted to allow the flow of hydraulic fluid from the hydraulic pump 304 to each of the bores 310, 312 and the pistons 306, 308, and vice versa.

The system 300 also includes a controller 316. The controller 316 may be any control unit configured to perform various functions of the system 300. In one embodiment, the controller 316 may be a dedicated control unit configured to perform functions related to the system 300. In another embodiment, the controller 316 may be a Machine Control Unit (MCU) associated with the motor grader 100, an Engine Control Unit (ECU) associated with the engine, and so on, configured to perform functions related to the system 300. The controller 316 is communicably coupled to the mechanism 302 and the side shift cylinder 222. Accordingly, in the illustrated embodiment, the controller 316 is communicably coupled to each of the hydraulic pump 304, the hydraulic valve 314, and the side shift cylinder 222.

The controller 316 is configured to receive a signal indicative of actuating the adjustment mechanism 302. In one embodiment, the controller 316 may receive the signal indicative of actuating the adjustment mechanism 302 based on an operator input. In such a situation, the controller 316 may receive the signal indicative of actuating the mechanism 302 from an operator input device 318 communicably coupled to the controller 316. The operator input device 318 may be any input device, such as a switch, a lever, a knob, an on-screen button, and so on, based on application requirements. Also, the operator input device 318 may be provided on any location on the motor grader 100, such as on the frame 104 of the motor grader 100, within the operator cabin 112, and so on, based on application requirements. Accordingly, an operator may interact with the operator input device 318 in order to provide the signal indicative of actuating the mechanism 302 to the controller 316.

In another embodiment, the controller 316 may receive the signal indicative of actuating the adjustment mechanism 302 based on a predefined period of time. In one embodiment, the predefined period of time may be predefined number of hours of operation of the motor grader 100. In another embodiment, the predefined period of time may be predefined number of hours or days from a previous blade adjustment cycle. As such, the predefined period of time may be any predefined time duration, based on application requirements. In one embodiment, the predefined period of time may be stored in an internal memory (not shown) of the controller 316. In another embodiment, the predefined period of time may be stored in a database (not shown) communicably coupled to the controller 316. Accordingly, as the predefined period of time may reach or elapse, the controller 316 may receive the signal indicative of actuating the mechanism 302.

Based on the received signal, the controller 316 is configured to lift the blade 138 from the work surface 102. More specifically, the controller 316 is configured to actuate one or more actuators, such as the actuator 132 or any other actuator associated with the blade assembly 124. In one embodiment, the controller 316 may be communicably coupled to the one or more actuators 132 in order to actuate the one or more actuators 132 to lift the blade 138 from the work surface 102. In another embodiment, the controller 316 may be communicably coupled to a dedicated control unit (not shown) associated with the one or more actuators 132. In such a situation, the controller 316 may actuate the one or more actuators 132 to lift the blade 138 from the work surface 102 via the dedicated control unit.

The controller 316 is configured to actuate the adjustment mechanism 302 to force the wear element 320 against the surface of the blade 138. In the illustrated embodiment, the surface of the blade 138 is the mounting rail 218. More specifically, the controller 316 is configured to actuate the hydraulic pump 304 to provide the flow of hydraulic fluid within the mechanism 302. The controller 316 is also configured to actuate the hydraulic valve 314 in the open position. As such, the flow of hydraulic fluid is provided within each of the bores 310, 312 provided within the mounting bracket 210. Accordingly, due to an increasing pressure of the hydraulic fluid within each of the bores 310, 312, each of the pistons 306, 308 is forced in the direction "D1" along the lateral axis Y-Y. The movement of each of the pistons 306, 308, in turn, forces the adjustment block 212 and the wear element 320 in the direction "D1" along the lateral axis Y-Y' against the mounting rail 218.

Figure 3D:
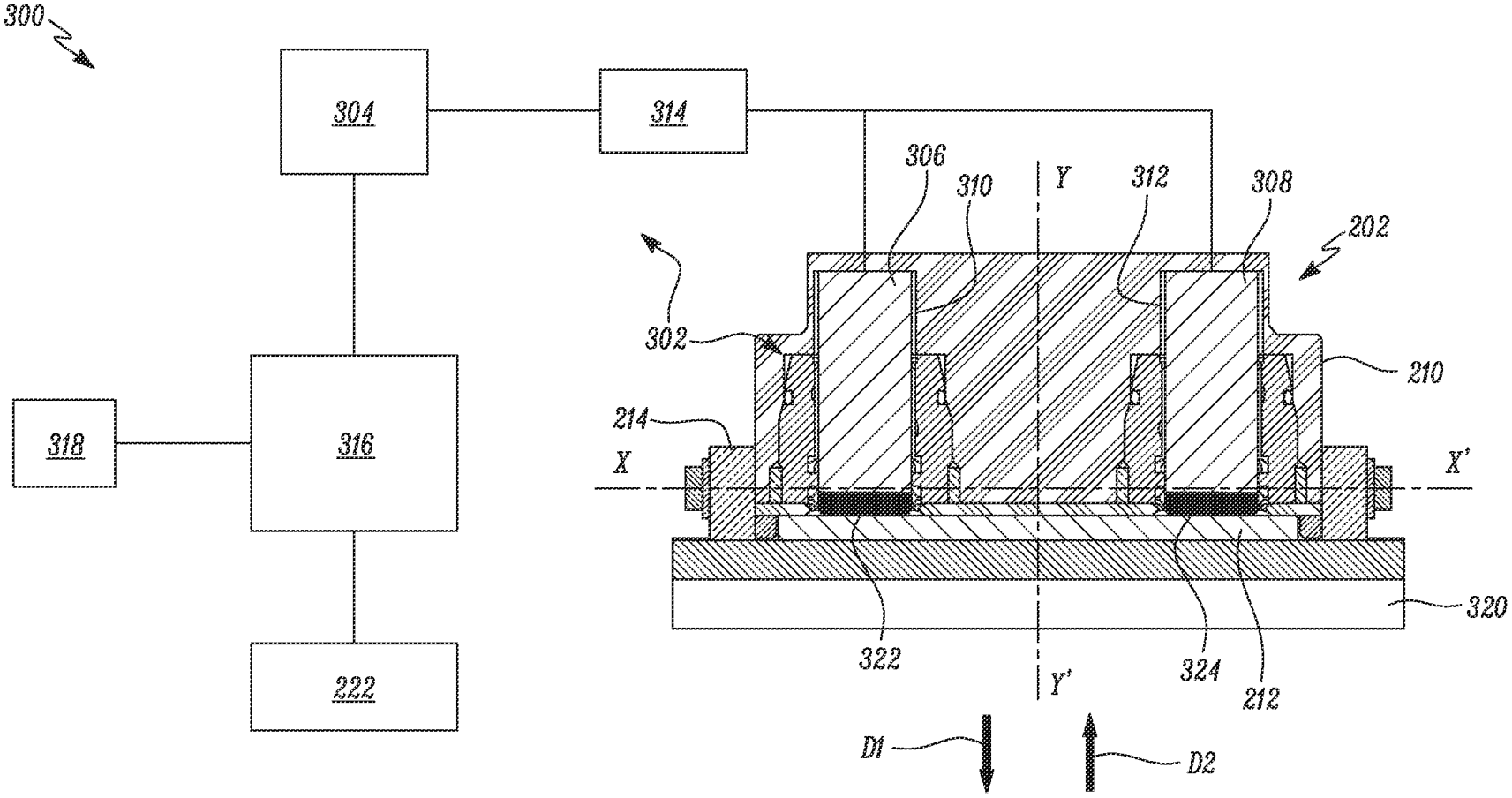
FIG. 3D is another schematic representation of the adjustment mechanism of FIG. 3B showing a cross-sectional view of a mounting bracket of the blade assembly of FIG. 2 in an unforced position, according to one or more embodiments of the present disclosure.

As shown in FIG. 3D, the controller 316 is configured to release the adjustment mechanism 302 to unforce the wear element 320 against the surface of the blade 138. More specifically, the controller 316 is configured to switch the adjustment mechanism 302 to a float mode. In such a situation, the controller 316 is configured to deactivate the hydraulic pump 304 to limit the flow of hydraulic fluid within the mechanism 302. The controller 316 is also configured to actuate the hydraulic valve 314 in the open position. As such, the flow of hydraulic fluid is limited within each of the bores 310, 312 provided within the mounting bracket 210 as shown by elements 322, 324. Accordingly, due to reduced pressure of the hydraulic fluid within each of the bores 310, 312, each of the pistons 306, 308 may move in any of the direction "D1" or a direction "D2" along the lateral axis Y-Y', configuring the wear element 320 in an unforced position.

The controller 316 is also configured to actuate the at least one side shift cylinder 222 to move the blade 138 in a first direction "FD". In the illustrated embodiment, the first direction "FD" is along the longitudinal axis X-X' or the pivot axis P-P. As the blade 138 is moved to an extreme point in the first direction "FD", the controller 316 is configured to actuate the at least one side shift cylinder 222 to move the blade 138 in a second direction "SD". In the illustrated embodiment, the second direction "SD" is substantially opposite to the first direction "FD". As such, the second direction "SD" is along the longitudinal axis X-X' or the pivot axis P-P.

As the blade 138 is moved to an extreme point in the second direction "SD", the controller 316 is further configured to lock the adjustment mechanism 302 to retain the wear element 320 against the surface of the blade 138. More specifically, the controller 316 is configured to actuate the hydraulic valve 314 to the closed position. As such, the flow of hydraulic fluid within the mechanism 302, such as from each of the pistons 306, 308 toward the hydraulic valve 314 and the hydraulic pump 304, is limited. Accordingly, due to static pressure of the hydraulic fluid within the mechanism 302, movement of each of the pistons 306, 308 in the direction "D2" along the lateral axis Y-Y' of the mounting bracket 210 is limited. As such, the wear element 320 is retained in a fixed position against the mounting rail 218.

It should be noted that although the mechanism 302 is described herein with reference to the hydraulic pump 304 and the hydraulic valve 314, the mechanism 302 may include additional elements not described herein, such as one or more switches, fluid lines, sensors, sealing elements, and so on, based on application requirements. It should also be noted that although the system 300 and the mechanism 302 is described herein with reference to the first mounting assembly 202, in other embodiments, the system 300 and the mechanism 302 may be, additionally or alternatively, disposed in association with one or more of the first mounting assembly 204, the second mounting assembly 206, and/or the second mounting assembly 208. It should further be noted that although the mechanism 302 described herein is the hydraulic adjustment mechanism, in other embodiments, the mechanism 302 may be a pneumatic adjustment mechanism. In such a situation, the controller 316 may be communicably coupled to and may control various components (not shown) of the pneumatic adjustment mechanism, such as a pneumatic pump, a pneumatic valve, and so on, in order to adjust and retain the wear element 320 relative to the mounting rail 218 in a manner similar to that described with reference to the mechanism 302.

In other embodiments, the mechanism 302 may be an electromechanical adjustment mechanism. In such a situation, the controller 316 may be communicably coupled to and may control various components (not shown) of the electromechanical adjustment mechanism, such as an electric actuator/motor, one or more electrical/electronic switches, one or more linkage elements, and so on, in order to adjust and retain the wear element 320 relative to the mounting rail 218 in a manner similar to that described with reference to the mechanism 302. In yet other embodiments, the mechanism 302 may be an electromagnetic adjustment mechanism. In such a situation, the controller 316 may be communicably coupled to and may control various components (not shown) of the electromagnetic adjustment mechanism, such as a magnetic actuator, one or more electrical/electronic switches, one or more linkage elements, and so on, in order to adjust and retain the wear element 320 relative to the mounting rail 218 in a manner similar to that described with reference to the mechanism 302.

INDUSTRIAL APPLICABILITY

Figure 4:
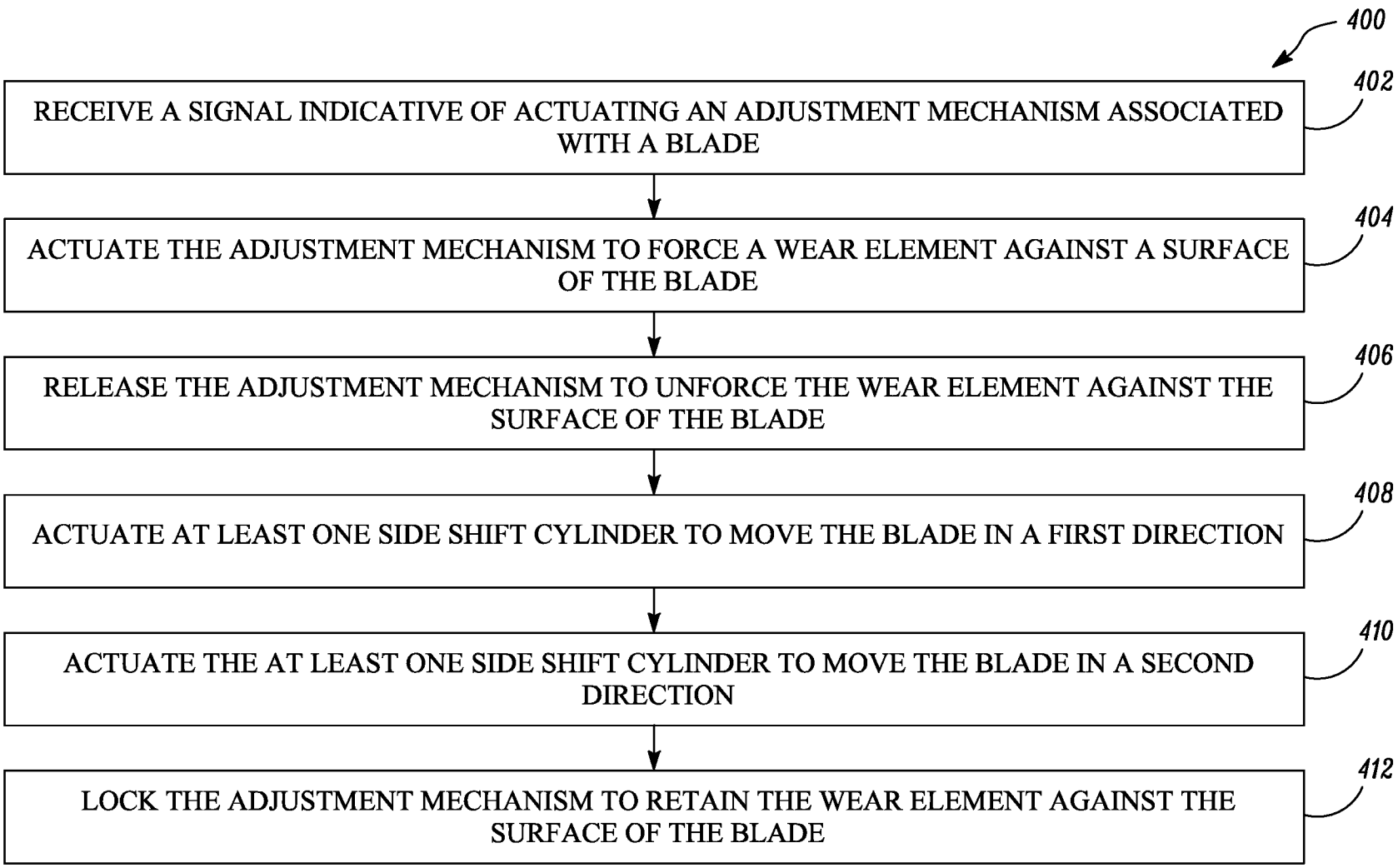
FIG. 4 is a flowchart of a method of adjusting a blade of the blade assembly of FIG. 2, according to one embodiment of the present disclosure.

The present disclosure relates to a method 400 of adjusting the blade 138 of the motor grader 100. Referring to FIG. 4, a flowchart of the method 400 of adjusting the blade 138 of the motor grader 100 using the system 300 and the mechanism 302 is illustrated. At step 402, the controller 316 receives the signal indicative of actuating the mechanism 302 associated with the blade 138. In one embodiment, the controller 316 may receive the signal indicative of actuating the mechanism 302 based on the operator input via the operator input device 318 communicably coupled to the controller 316. In another embodiment, the controller 316 may receive the signal indicative of actuating the mechanism 302 based on the predefined period of time, such as predefined number of hours of operation of the motor grader 100, predefined number of hours or days from the previous blade adjustment cycle, and so on, based on application requirements.

Based on the received signal, the controller 316 is configured to lift the blade 138 from the work surface 102. More specifically, the controller 316 is configured to actuate one or more actuators 132 associated with the blade assembly 124 in order to lift the blade 138 from the work surface 102. At step 404, the controller 316 is configured to actuate the mechanism 302 to force the wear element 320 against the surface of the blade 138. In the illustrated embodiment, the mechanism 302 is the hydraulic adjustment mechanism. In the other embodiments, the mechanism 302 may be the pneumatic adjustment mechanism, the electromechanical adjustment mechanism, or the electromagnetic adjustment mechanism, or a combination thereof.

Accordingly, the controller 316 is configured to actuate the hydraulic pump 304 to provide the flow of hydraulic fluid within the mechanism 302. The controller 316 is also configured to actuate the hydraulic valve 314 in the open position. As such, the flow of hydraulic fluid is provided within each of the bores 310, 312 provided within the mounting bracket 210. Accordingly, due to the increasing pressure of the hydraulic fluid within each of the bores 310, 312, each of the pistons 306, 308 is actuated and forced in the direction "D1" along the lateral axis Y-Y. The movement of each of the pistons 306, 308, in turn, forces the adjustment block 212 and the wear element 320 in the direction "D1" along the lateral axis Y-Y' against the mounting rail 218.

At step 406, the controller 316 is configured to release the mechanism 302 to unforce the wear element 320 against the surface of the blade 138. More specifically, the controller 316 is configured to switch the mechanism 302 to the float mode. In such a situation, the controller 316 is configured to deactivate the hydraulic pump 304 to limit the flow of hydraulic fluid within the mechanism 302. The controller 316 is also configured to actuate the hydraulic valve 314 in the open position. As such, the flow of hydraulic fluid is limited within each of the bores 310, 312 provided within the mounting bracket 210. Accordingly, due to reduced pressure of the hydraulic fluid within each of the bores 310, 312, each of the pistons 306, 308 may move in any of the direction "D1" or the direction "D2" along the lateral axis Y-Y.

At step 408, the controller 316 is also configured to actuate the at least one side shift cylinder 222 to move the blade 138 in the first direction "FD". As the blade 138 is moved to the extreme point in the first direction "FD", at step 410, the controller 316 is configured to actuate the at least one side shift cylinder 222 to move the blade 138 in the second direction "SD". The movement of the blade 138 in the first direction "FD" and the second direction "SD" while the mechanism 302 is switched in the float mode allows positional adjustment of the wear element 320 and the adjustment block 212 within the mounting bracket 210 relative to dimensional tolerances and/or alignment of the mounting rail 218 of the blade 138.

As the blade 138 is moved to the extreme point in the second direction "SD", at step 412, the controller 316 is further configured to lock the mechanism 302 to retain the wear element 320 against the surface of the blade 138. More specifically, the controller 316 is configured to actuate the hydraulic valve 314 to the closed position. As such, the flow of hydraulic fluid within the mechanism 302, such as from each of the pistons 306, 308 toward the hydraulic valve 314 and the hydraulic pump 304, is limited. Accordingly, due to static pressure of the hydraulic fluid within the mechanism 302, movement of each of the pistons 306, 308 in the direction "D2" along the lateral axis Y-Y' of the mounting bracket 210 is limited. As such, the wear element 320 is retained in the fixed position against the mounting rail 218.

The system 300 and the mechanism 302 provide a simple and efficient method of adjusting the blade 138 of the motor grader 100. As such, the system 300 provides a single touch actuation of the mechanism 302 via the operator input device 318 or automatic actuation of the mechanism 302 via the predefined period of time in order to adjust the blade 138 of the motor grader 100, in turn, reducing labor effort, reducing service duration, reducing service cost, reducing machine downtime, reducing operational cost, improving productivity, and so on. The system 300 and the mechanism 302 may employ simple and readily or already available components on the motor grader 100, such as the hydraulic pump 304, the hydraulic valve 314, the controller 316, and so on, in turn, reducing system cost and complexity. The system 300 and the mechanism 302 may be retrofitted on any motor grader with little or no modification to the existing system, in turn, improving usability, flexibility, and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. An adjustment system for a blade of a motor grader, the adjustment system comprising:

an adjustment mechanism disposed in association with a wear element of the blade; and a controller communicably coupled to the adjustment mechanism, the controller configured to:

receive a signal indicative of actuating the adjustment mechanism;

actuate the adjustment mechanism to force the wear element against a surface of the blade;

release the adjustment mechanism to unforce the wear element against the surface of the blade;

actuate at least one side shift cylinder to move the blade in a first direction;

actuate the at least one side shift cylinder to move the blade in a second direction, the second direction being opposite to the first direction; and lock the adjustment mechanism to retain the wear element against the surface of the blade.

2. The adjustment system of claim 1, wherein the controller receives the signal indicative of actuating the adjustment mechanism based on at least one of an operator input and a predefined period of time.

3. The adjustment system of claim 1, wherein releasing the adjustment mechanism includes switching the adjustment mechanism to a float mode.

4. The adjustment system of claim 1, wherein actuating the adjustment mechanism further includes lifting the blade from a work surface.

5. The adjustment system of claim 1, wherein the adjustment mechanism is a hydraulic adjustment mechanism including:

a hydraulic pump communicably coupled to the controller;

a piston operably coupled to each of the hydraulic pump and the wear element; and a hydraulic valve communicably coupled to the controller and operably coupled to each of the hydraulic pump and the piston.

6. The adjustment system of claim 1, wherein the adjustment mechanism is at least one of a pneumatic adjustment mechanism, an electromechanical adjustment mechanism, and an electromagnetic adjustment mechanism.

7. The adjustment system of claim 1, wherein the adjustment mechanism is disposed in association with a mounting bracket of the blade.

8. A blade assembly for a motor grader, the blade assembly comprising:

a blade adapted to engage a work surface;

a mounting bracket disposed on a frame of the motor grader;

a wear element disposed within the mounting bracket, the wear element adapted to movably receive a surface of the blade thereon; and an adjustment system comprising:

an adjustment mechanism disposed in association with the mounting bracket and the wear element; and a controller communicably coupled to the adjustment mechanism, the controller configured to:

receive a signal indicative of actuating the adjustment mechanism;

actuate the adjustment mechanism to force the wear element against the surface of the blade;

release the adjustment mechanism to unforce the wear element against the surface of the blade;

actuate at least one side shift cylinder to move the blade in a first direction;

actuate the at least one side shift cylinder to move the blade in a second direction, the second direction being opposite to the first direction; and lock the adjustment mechanism to retain the wear element against the surface of the blade.

9. The blade assembly of claim 8, wherein the controller receives the signal indicative of actuating the adjustment mechanism based on at least one of an operator input and a predefined period of time.

10. The blade assembly of claim 8, wherein releasing the adjustment mechanism includes switching the adjustment mechanism to a float mode.

11. The blade assembly of claim 8, wherein actuating the adjustment mechanism further includes lifting the blade from the work surface.

12. The blade assembly of claim 8, wherein the adjustment mechanism is at least one of a hydraulic adjustment mechanism, a pneumatic adjustment mechanism, an electromechanical adjustment mechanism, and an electromagnetic adjustment mechanism.

13. A method of adjusting a blade of a motor grader, the method comprising:

receiving a signal indicative of actuating an adjustment mechanism associated with the blade;

actuating the adjustment mechanism to force a wear element against a surface of the blade;

releasing the adjustment mechanism to unforce the wear element against the surface of the blade;

actuating at least one side shift cylinder to move the blade in a first direction;

actuating the at least one side shift cylinder to move the blade in a second direction; and locking the adjustment mechanism to retain the wear element against the surface of the blade.

14. The method of claim 13, wherein actuating the adjustment mechanism includes actuating each of a hydraulic pump, a hydraulic valve, and a piston to force the wear element against the surface of the blade.

15. The method of claim 14, wherein releasing the adjustment mechanism includes switching the hydraulic valve to a float mode.

16. The method of claim 15, wherein locking the adjustment mechanism includes closing the hydraulic valve.

17. The method of claim 13, wherein the signal indicative of actuating the adjustment mechanism is received based on at least one of an operator input and a predefined period of time.

18. The method of claim 13, wherein actuating the adjustment mechanism further includes lifting the blade from a work surface.

19. The method of claim 13, wherein the adjustment mechanism is at least one of a pneumatic adjustment mechanism, an electromechanical adjustment mechanism, and an electromagnetic adjustment mechanism.

20. The method of claim 19, wherein releasing the adjustment mechanism includes switching the adjustment mechanism to a float mode.

* * * * *